US006132006A

United States Patent [19]

Post

[11] Patent Number: 6,132,006

[45] **Date of Patent: *Oct. 17, 2000**

[54] IN-LINE SKATE WHEEL AXLE ASSEMBLY AND FRAME

[76] Inventor: Peter G. Post, 3167-7th Street, Boulder, Colo. 80304

[ * ] Notice: This patent is subject to a terminal disclaimer.

[21] Appl. No.: 09/116,331

[22] Filed: Jul. 15, 1998

Related U.S. Application Data

[63] Continuation-in-part of application No. 08/778,697, Jan. 3, 1997, and a continuation-in-part of application No. 08/834,944, Apr. 7, 1997.

[51] Int. Cl.[7] ..... B60B 27/00

[52] U.S. Cl. ..... 301/5.3; 301/111; 301/110.6; 280/11.22

[58] Field of Search ..... 301/5.3, 5.7, 110.5, 301/110.6, 111, 114, 120; 280/11.19, 11.22, 11.23; 411/348, 386; 24/453

[56] References Cited

U.S. PATENT DOCUMENTS

| | | | |
|---|---|---|---|
| 2,198,667 | 4/1940 | Hagenes . | |
| 3,282,598 | 11/1966 | Goodwin . | |
| 3,608,937 | 9/1971 | Nave | 411/348 X |
| 3,795,409 | 3/1974 | Cudmore . | |
| 4,093,252 | 6/1978 | Rue . | |
| 4,114,295 | 9/1978 | Schaefer . | |
| 4,150,838 | 4/1979 | Lappage . | |
| 4,232,497 | 11/1980 | Meschnig | 411/386 X |
| 4,403,784 | 9/1983 | Gray . | |
| 4,492,385 | 1/1985 | Olson . | |
| 5,088,749 | 2/1992 | Olivieri . | |
| 5,106,109 | 4/1992 | Tattersall et al. . | |
| 5,125,687 | 6/1992 | Hwang . | |
| 5,129,663 | 7/1992 | Soo . | |
| 5,160,155 | 11/1992 | Barachet . | |
| 5,193,827 | 3/1993 | Olson . | |
| 5,274,882 | 1/1994 | Persson . | |
| 5,314,199 | 5/1994 | Olson et al. . | |
| 5,314,241 | 5/1994 | Cheng . | |
| 5,388,846 | 2/1995 | Gierveld . | |
| 5,419,570 | 5/1995 | Bollotte . | |
| 5,470,086 | 11/1995 | Peterson et al. . | |
| 5,531,462 | 7/1996 | Gu . | |
| 5,549,331 | 8/1996 | Yun et al. . | |
| 5,601,299 | 2/1997 | Yun et al. . | |
| 5,882,087 | 3/1999 | Post | 301/5.3 |

*Primary Examiner*—Russell D. Stormer
*Attorney, Agent, or Firm*—Emery L. Tracy

[57] ABSTRACT

An axle assembly for in-line skate wheels is provided. Each wheel is arranged between frame extensions having a plurality of opposing apertures. The axle assembly comprises a housing having a first open end, a second open end, and a longitudinal axis. A first tapered axle end is movable along the longitudinal axis within the first open end of the housing. A second tapered axle end is movable along the longitudinal axis within the second open end of the housing. A mechanism biases the ends in a general direction away from each other to urge the ends into the opposing apertures in the frame extensions.

14 Claims, 9 Drawing Sheets

IN-LINE SKATE WHEEL AXLE ASSEMBLY AND FRAME

CROSS-REFERENCE TO RELATED APPLICATIONS

This application is a continuation-in-part of pending U.S. patent application Ser. No. 08/778,697, filed on Jan. 3, 1997, entitled "Quick Release In-Line Skate Wheel Axle, and a continuation-in-part of pending U.S. patent application Ser. No. 08/834,944, filed Apr. 7, 1997, entitled "In-Line Skate Frame and Tool Device Adapted For Quick-Release In-Line Skate Wheel Axle".

BACKGROUND OF THE INVENTION

1. Field of the Invention

This invention relates generally to a quick release in-line skate wheel axle and frame and, more particularly, it relates to a quick release in-line skate wheel axle and frame in which the axle has tapered ends and the frame has tapered axle apertures.

2. Description of the Prior Art

Today, in-line roller skating is a popular activity enjoyed by many recreationists and enthusiasts. Because of the ever increasing popularity, many manufacturers have developed and continue to develop new and improved in-line skates. In the prior art, many references focus on removing the blade from the boot. Evidently, however, prior to the filing of the cross-referenced patent application entitled "Quick Release In-Line Skate Wheel Axle", above, no references providing for quick release of the individual wheels and/or axles of an in-line skate are known.

To date, traditional methods of attaching the skate wheels to the blade frame utilize a bolt axle bolted to the blade frame by conventional methods. Attachment of the bolt axles to the blade frame is generally accomplished by using at least one or more wrenches; one wrench on each side of the of the blade frame. Upon attachment to the blade frame, the bolt heads on the bolt axle are generally positioned outside the blade frame. Positioning the bolt heads outside the blade frame often subjects the bolt heads to extreme wear since the bolt head will frequently contact the skating surface when the in-line skate is angled during turns, intentionally scraped along by the skater during specific skate maneuvers, etc. In fact, often the bolt heads wear to the point that the bolt axles can not be removed from the blade frame using a conventional wrench. In a few instances, the skate wheels are actually riveted to the blade frame and are essentially not removable from the blade frame by conventional methods.

In the prior art, other in-line skate wheels are retained to the blade using bushings and other such methods. Also, the prior art further describes systems wherein the in-line skate itself is disconnectable from the boot. See, for example, the Olsen et al, U.S. Pat. No. 5,314,199. Nevertheless, all of the above designs require additional, and sometimes cumbersome, tools to disconnect the wheels from the frame, if the wheels can be disconnected at all!

SUMMARY OF THE INVENTION

The present invention provides an axle assembly for in-line skate wheels. Each wheel is arranged between frame extensions having a plurality of opposing apertures. The axle assembly comprises a housing having a first open end, a second open end, and a longitudinal axis. A first tapered axle end is movable along the longitudinal axis within the first open end of the housing. A second tapered axle end is movable along the longitudinal axis within the second open end of the housing. Means are provided for biasing the ends in a general direction away from each other to urge the ends into the opposing apertures in the frame extensions.

In an embodiment of the present invention, the ends are tapered to approximately five (5°) degrees.

In another embodiment of the present invention, the ends are movable along a longitudinal axis of the axle.

In still another embodiment of the present invention, the means for biasing comprises spring means for urging the ends apart.

In yet another embodiment of the present invention, each of the apertures in the frame extensions are tapered. Preferably, the taper of the apertures in the frame extensions is substantially equal to the taper of the ends.

In still yet another embodiment of the present invention, the axle assembly further includes means for limiting the extent of travel of the first and second ends relative to the housing.

The present invention further includes a method for mounting and removing a wheel from an in-line skate frame structure. The method comprises the steps of providing an axle having a pair of opposite movable ends, providing a taper on each of the movable ends of the axle, inserting the axle into the wheel, providing a plurality of opposing apertures in the frame structure, and depressing the movable ends of the axle of the wheel with the movable ends of each of the axles extending through each pair of opposing apertures in the frame structure.

In an embodiment of the present invention, the method further comprises slipping the wheel from the blade frame when the ends of the axle clear the inner surfaces of the frame structure. Preferably, the method further comprises depressing the movable ends of the axle of the wheel and slipping the wheel into the blade frame when the ends of the axle clear the inner surfaces of the frame structure.

The present invention further includes a blade frame for an in-line skate. The blade frame carries at least one wheel assembly. The wheel assembly has a wheel axle with a first axle end and a second axle end movable toward each other and biased in a direction generally away from each other and retained in a housing. The blade frame comprises a tapered portion within the apertures.

In an embodiment of the present invention, the tapered portion has taper of approximately five (5°) degrees.

In another embodiment of the present invention, the first and second axle ends have a tapered portion. Preferably, the tapered portion of the axle aperture is substantially equal to the tapered portion of the first and second axle portions.

DETAILED DESCRIPTION OF THE PREFERRED EMBODIMENTS

Figure 1A:
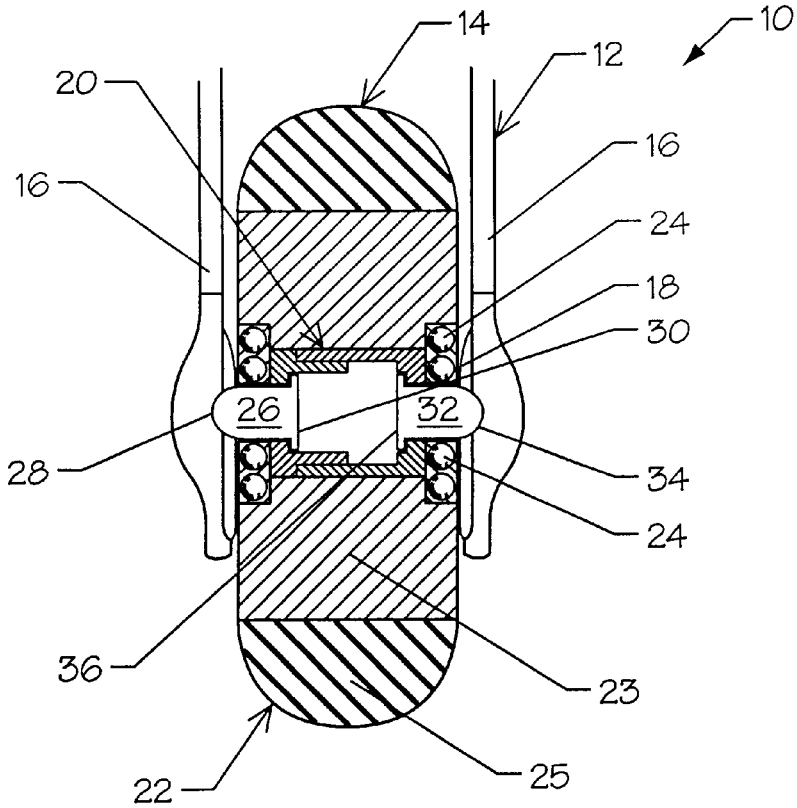
FIG. 1*a* is a sectional view illustrating an embodiment of the in-line skate wheel axle assembly constructed in accordance with the present invention.

As illustrated in FIG. 1, the present invention is a quick-release in-line skate wheel axle assembly, indicated generally at 10, for an in-line skate (not shown). Typically, the in-line skate has a boot portion (not shown), a blade frame 12, and a wheel assembly 14. The blade frame 12 has a pair of side walls 16 and opposing apertures 18 formed in the side walls 16. The blade frame 12 is mounted to the boot portion and the wheel assembly 14 is mounted within the blade frame 12. The wheel assembly 14 includes a wheel axle assembly 20, at least one wheel 22 having a wheel hub 23 and friction material 25 rotatably mounted about the wheel axle assembly 20, and a plurality of ball bearings 24 mounted between the wheel 22 and the wheel axle assembly 20 to provide free rotation of the wheel 22 about the wheel axle assembly 20. While the wheel assembly 14 is being described heretofore and hereafter as rotating about the ball bearings 24, other types of wheel assemblies utilized on in-line skates are within the scope of the present invention.

Figure 1B:
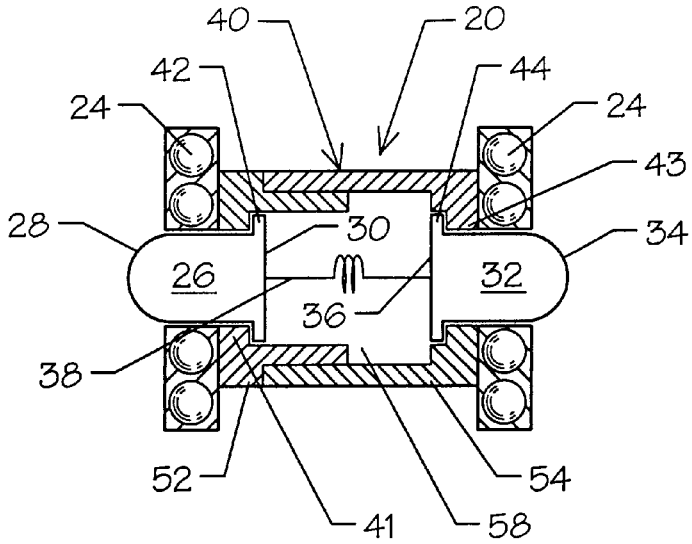
FIG. 1*b* is a sectional view illustrating the embodiment of FIG. 1*a* of the in-line skate wheel axle assembly constructed in accordance with the present invention.

As illustrated in FIGS. 1*a* and 1*b*, in a first embodiment of the quick-release wheel axle assembly 10 of the present invention, the wheel axle assembly 20 comprises a first tubular member 26 having a first end 28 and a second end 30, a second tubular member 32 having a first end 34 and a second end 36, and a spring member 38. The first tubular member 26 extends through the in-line skate blade frame 12 with the open second end 30 of the first tubular member 26 telescoping into the housing 40, and a second open end 36 of the second tubular member 32 at an approximate location between the side walls 16 of the blade frame 12 also telescopicable into the housing 40. The spring member 38 is situated between the housing, the first end 28 of the first tubular member 26 and the first end 34 of the second tubular member 32 biasing the first tubular member 26 in a direction generally away from the second tubular member 32 into the apertures 18 in the blade frame 12.

Still referring to FIGS. 1*a* and 1*b*, the first tubular member 26 has a shoulder 42 and the second tubular member 32 has a shoulder 44 that are designed and constructed to mate with a corresponding shoulder 41 and corresponding shoulder 43, respectively, on the housing 40. Alternatively, the shoulders 42, 44 can mate with the ball bearings 24 that are either a part of the roller wheel hub itself or separately fixed to the roller wheel hub 23.

Figure 4:
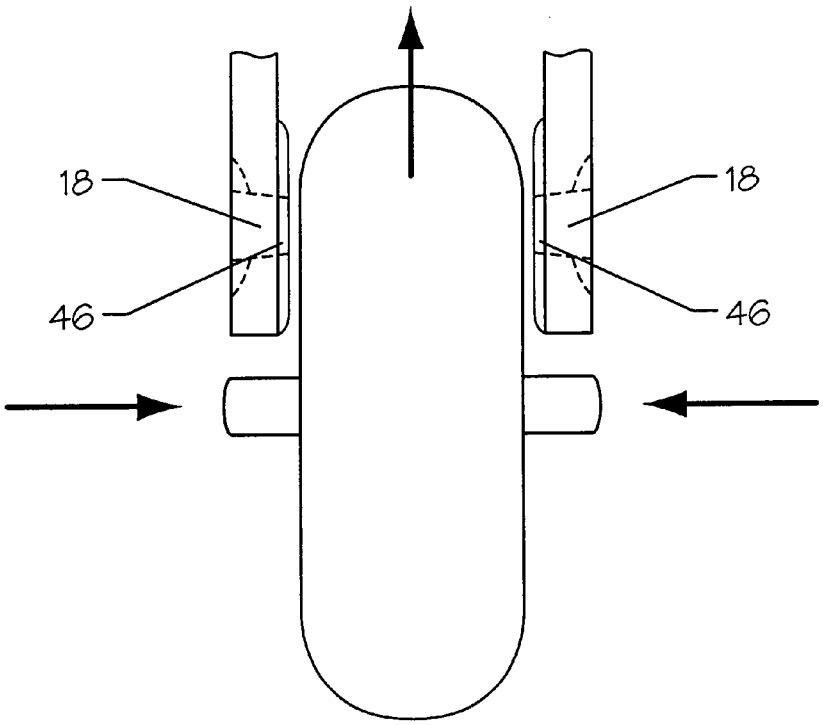
FIG. 4 is a front view illustrating the in-line skate wheel axle assembly and the wheel being inserted within an in-line skate frame.
Figure 5:
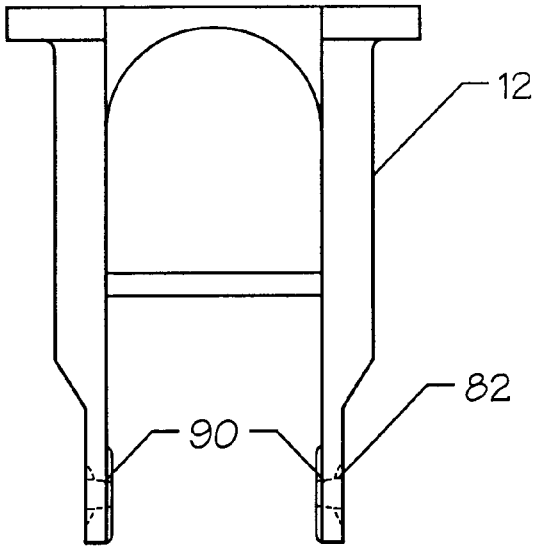
FIG. 5 is a front view illustrating the blade frame constructed in accordance with the present invention.

As illustrated in FIG. 4, spacers 46 can be provided in another preferred embodiment between the side walls 16 and the ball bearings 24. The spacers 46 can be constructed as part of the frame 12 itself or as separate pieces. An advantage of the quick-release wheel axle 10 of the present invention over the prior art in this regard is that the action of the shoulders 42, 44 and the spacers 46 fills any space present due to variations inherent in manufacturing of the blade frame 12 and the wheel 22. The variations typically cause the wheel of the in-line skate to wobble which causes potentially dangerous instability and increased wheel and axle wear.

Figure 2:
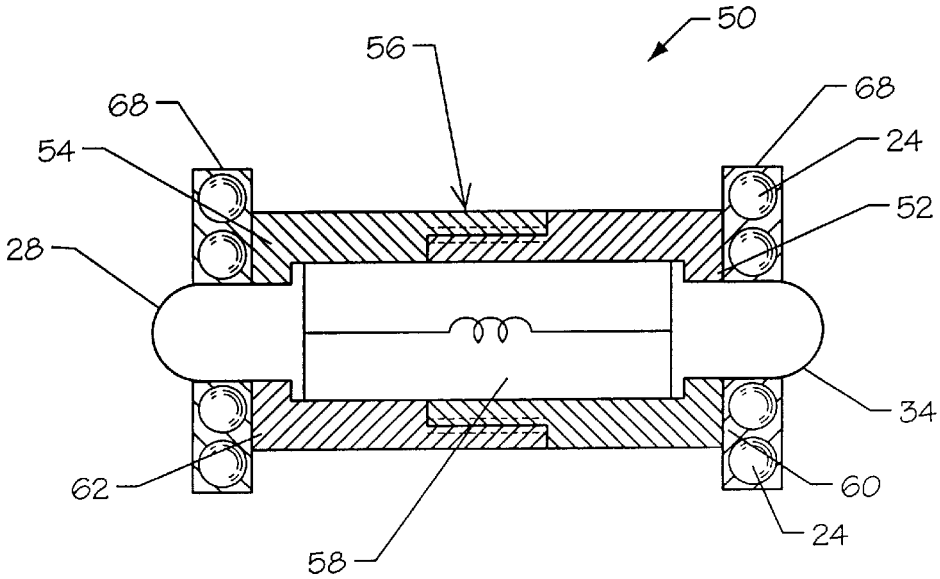
FIG. 2 is an sectional view illustrating another embodiment of the in-line skate wheel axle assembly constructed in accordance with the present invention.

The quick-release skate wheel axle assembly 10 of the present invention, as illustrated in FIGS. 1*a*, 1*b*, and 2, the housing 40 has a first tubular member 52 and a second tubular member 54 preferably threaded (FIG. 2) or press-fit (FIGS. 1*a* and 1*b*) or welded together forming a single tube having an inner substantially cylindrical chamber 58. The housing 40 has a pair of annular lip portions 41, 43 at each end of the inner chamber 58 wherein the diameter of the inner chamber 58 of the single tube is greater than the diameter of the ends of the single tube. The axle ends 26 and 32 have shoulders 64, 66 accommodating the ball bearings as described above.

Figure 3:
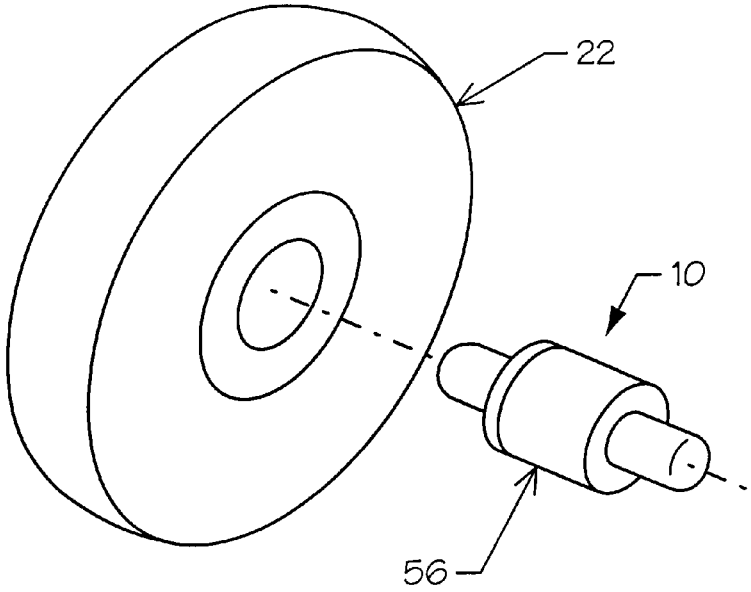
FIG. 3 is a perspective view illustrating the orientation as the in-line skate wheel axle assembly is inserted into the wheel assembly.

As illustrated in FIG. 3, to construct the wheel assembly 14 of the present invention, the wheel axle assembly 10 is inserted into the wheel 22 normally between two ball bearings. As illustrated in FIG. 4, the wheel assembly 14 is inserted between the side walls 14 of the blade frame 12. The user simply squeezes the closed first ends 28, 34 of the first and second tubular members 26, 32, respectively, toward each other overcoming the bias of the spring member 38. The user then slides the wheel assembly 14 between the blade frame side walls 16 until the closed first ends 28, 34 of the first and second tubular members 26, 32, respectively, are aligned with the opposing apertures 18 of the blade frame 12. When the first closed ends 28, 34 of the first and second tubular members 26, 32, respectively, are released by the user, the bias of the spring member 38 causes the first closed ends 28, 34 to be matingly received by the opposing apertures 18. It should be noted that no tools are required to insert the wheel assembly 14 into the blade frame 12.

Removing the wheel assembly 14 is accomplished by simply reversing the process as described immediately above. The user simply squeezes the closed first ends 28, 34 of the first and second tubular members 26, 32, respectively, overcoming the bias of the spring member 38. The wheel assembly 14 is then manipulated until the closed first ends 28, 34 of the first and second tubular members 26, 32, respectively, are free from the opposing apertures 18. Finally, the wheel assembly 14 is moved clear of the blade frame 12.

Other methods include bayonet type mechanisms and, as discussed above, spring washer mechanisms, and preferred embodiments where either spring compression or tension may be used to retain the axle and wheel to the blade frame while allowing manual quick release of the axle and wheel. Other types of springs and spring material may be, for example, an elastomer or rubber material placed in the axle, a gas or fluid filled bladder, or even magnets with opposing poles might be used in place of a spring in compression to provide a force that drives the poles apart. Like poles would be equivalent to a spring in tension. Other spring forces can be found in particular types of washer designs, e.g. split and beveled.

Figure 8:
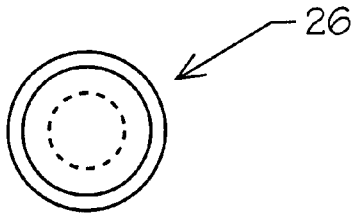
FIG. 8 is a top view illustrating the portion of the tapered in-line skate wheel axle end as illustrated in FIG. 7.
Figure 9:
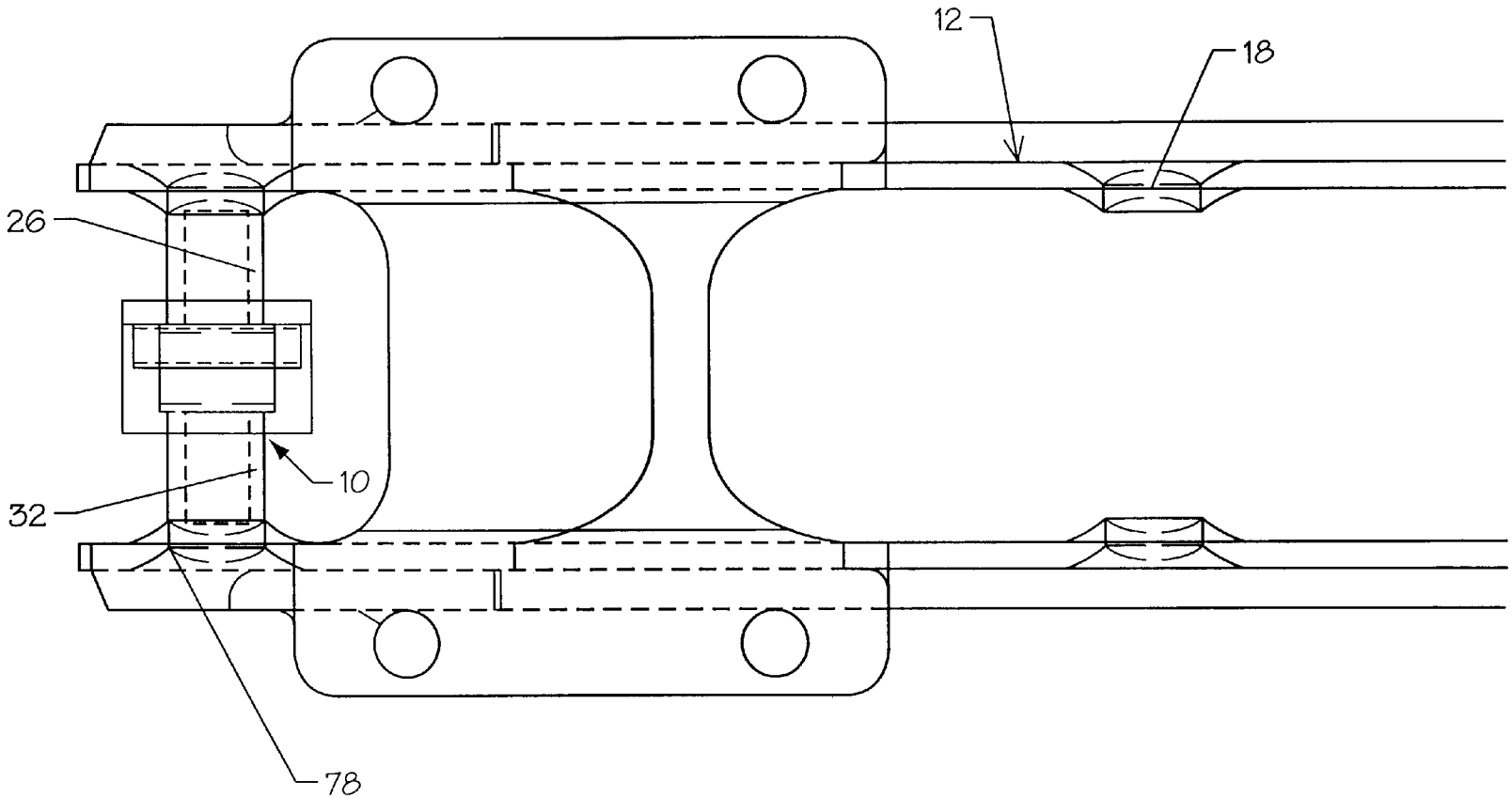
FIG. 9 is a top view illustrating the blade frame with tapered apertures constructed in accordance with the present invention.

The preferred embodiments described and illustrated herein describe cylindrical axles. However, although the axle 10 is designed and constructed to accommodate a rotating wheel 22 with ball bearings, bushings and the like, the axle 10 need not be cylindrical throughout its length. As illustrated in FIGS. 8 and 9, the first and second tubular members 26, 32 can have a tapered portion 76 either through the length of the first and second tubular members 26, 32, or from any given point along the first and second tubular members 26, 32. Preferably, the tapered portion 76 is from a larger diameter to a smaller diameter from the inside to the outside of the first and second tubular members 26, 32. The purpose of the tapered portion 76 is to allow for maximum connection between the first and second tubular members 26, 32 and the axle apertures 18 of the frame 12 within the range of tolerances common to mass-manufacture of in-line skates and other types of products. For example, if an axle aperture 18 is at the maximum of the allowable tolerance and first and second tubular members 26, 32 are at the minimum of the allowable tolerance, there could be a gap between the axle aperture 18 and the first and second tubular members 26, 32 causing the axle 10 to vibrate within the axle apertures 18 potentially creating an unpleasant sound during skating. With the tapered portion 76 of the present invention, like a truncated cone, with a greater diameter at the inside end than the diameter of the axle aperture 18, there would always be contact between the axle 10 and the axle aperture 18 thus inhibiting the possibility of a sound created by the first and second tubular members 26, 32 striking the inside of the axle aperture 18.

Figure 10:
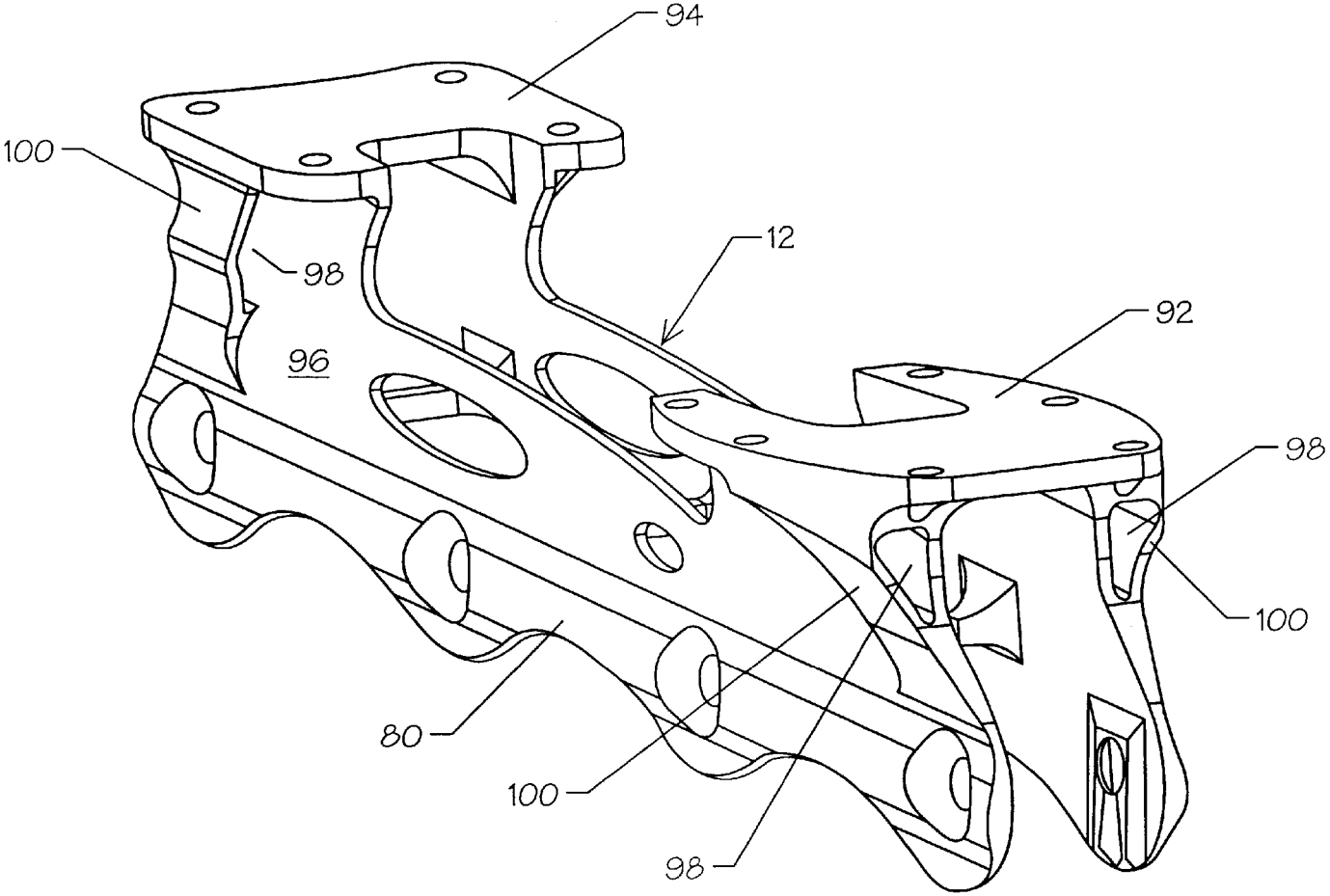
FIG. 10 is a perspective view illustrating wings formed in the blade frame constructed in accordance with the present invention.
Figure 11:
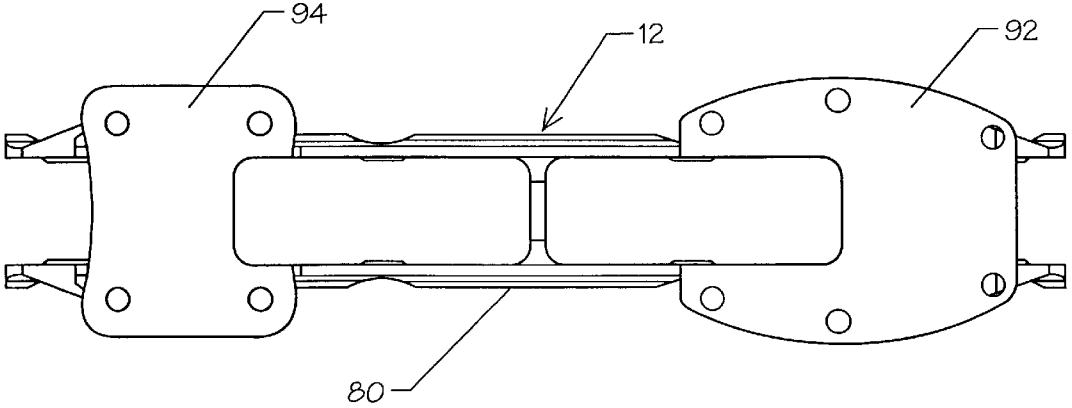
FIG. 11 top view illustrating the blade frame of FIG. 10 constructed in accordance with the present invention.
Figure 12:
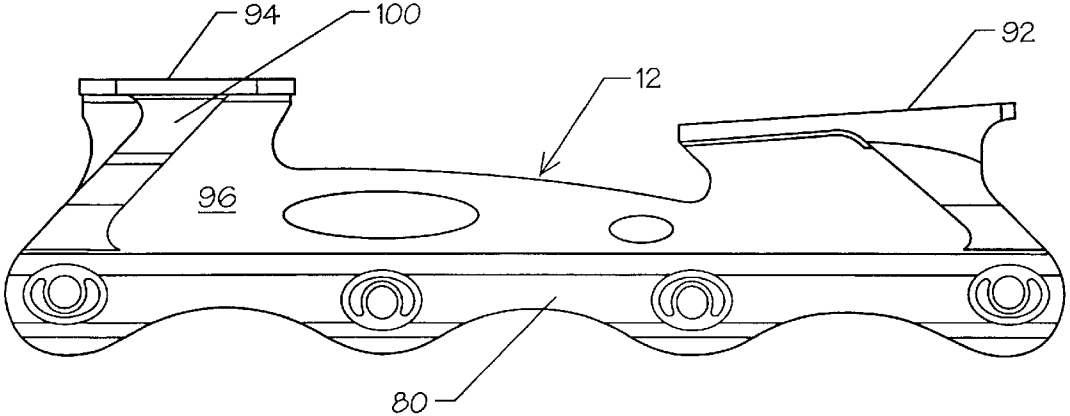
FIG. 12 is a side view illustrating the blade frame of FIG. 10 constructed in accordance with the present invention.
Figure 13:
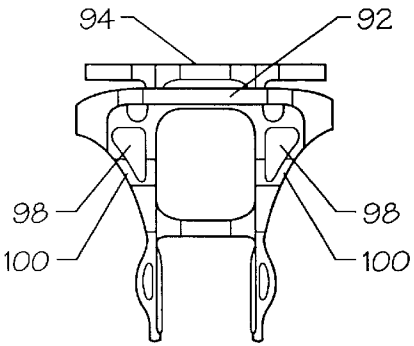
FIG. 13 is an end view illustrating the blade frame of FIG. 10 constructed in accordance with the present invention.

As further illustrated in FIG. 10, the axle aperture 18 further includes a tapered portion 78 for receiving the tapered portion of the first and second tubular members 26, 32. The tapered portion 78 of the axle aperture 18 of the frame 12 can be from a larger diameter on the inside edge of the axle aperture 18 to a smaller diameter on the outside edge of the axle aperture 18. The diameter of the axle aperture 18 at its greatest diameter is preferably substantially equal to the diameter of the tapered portion of the first and second tubular members 26, 32 at its greatest diameter. Together, the tapered portion of the first and second tubular members 26, 32 and the tapered portion 78 of the axle aperture 78 increases the possibility for a snug fit between the axle 10 and the axle aperture 18 even if the axle 10 is at the small end of the tolerance range and the axle aperture 18 is at the large end of the tolerance range.

Preferably, the tapered portion 76 of the first and second tubular portions 26, 32 and the tapered portion 78 of the axle aperture 18 have substantially equal taper angles.

In a preferred embodiment, the tapered portions 76, 78 of both the axle 10 and the axle aperture 18 are each approximately five (5°) degrees. It should be noted, however, that having a tapered portion 76, 78 greater than or less than five (5°) degrees is within the scope of the present invention.

Square sectioned or keyed parts of the axle, so as to fit into the blade frame holes on a particular orientation prohibiting axle rotation, can be used in the present invention. In addition, the construction of the axle to allow relative longitudinal movement of the two ends can be accomplished with axles that are not fully cylindrical as are known in the art. For example, a spaced tongue and groove arrangement where the tongue moves to and fro in the groove with a spring force arranged to drive the tongue out of the groove can be used. Another construction uses multiple tongues and grooves, for example.

In the embodiments described and illustrated herein, the axle tips protrude sufficiently through the blade frame side walls to facilitate removal of the in-line skate wheel incorporating the present invention, but not so far that axle tips or the axle itself can suffer any appreciable wear. It should be noted that it is within the scope of the present invention to have rounded tips to further facilitate installation and removal of the in-line skate wheel incorporating the present invention.

In a first embodiment of the present invention, the blade frame 12, including the axle housing and the wheel spacers, are machined from an extruded aluminum profile.

In another embodiment of the present invention, the blade frame 12 is machined from a solid piece of aluminum, such as aluminum 7075, for example, and has pressed-fit inserts (not shown) of stainless steel for receiving the wheel axles 10. In still another embodiment of the present invention, the side walls 16 of the blade frame 12 are molded from a high impact plastic. In this embodiment, the stainless steel axle hole inserts are preferably molded directly into the plastic blade frame 12. Also, in this embodiment, the heel and toe plates are constructed of stainless steel or other metal, such as aluminum 7075, for example, and are also preferably molded directly into the plastic. In still another embodiment, the aluminum or other such material of which the blade frame 12 is constructed is anodized or otherwise micro-coated with Titanium Nitrite (TiN), niflor, or other such known surface hardeners as are known in the art. The micro-coating described serves the same purpose as the stainless steel or other hardened metal inserts by providing a surface substantially as durable and resistant to wear as the quick-release axles themselves. The first and second closed ends 28, 34 are preferably constructed of stainless steel 17-4 pH or equivalent materials such as aluminum alloys. Also, the axle 10 and the blade frame 12 can be constructed from a process known as metal injection molding using such material as magnesium, titanium, etc.

Figure 6:
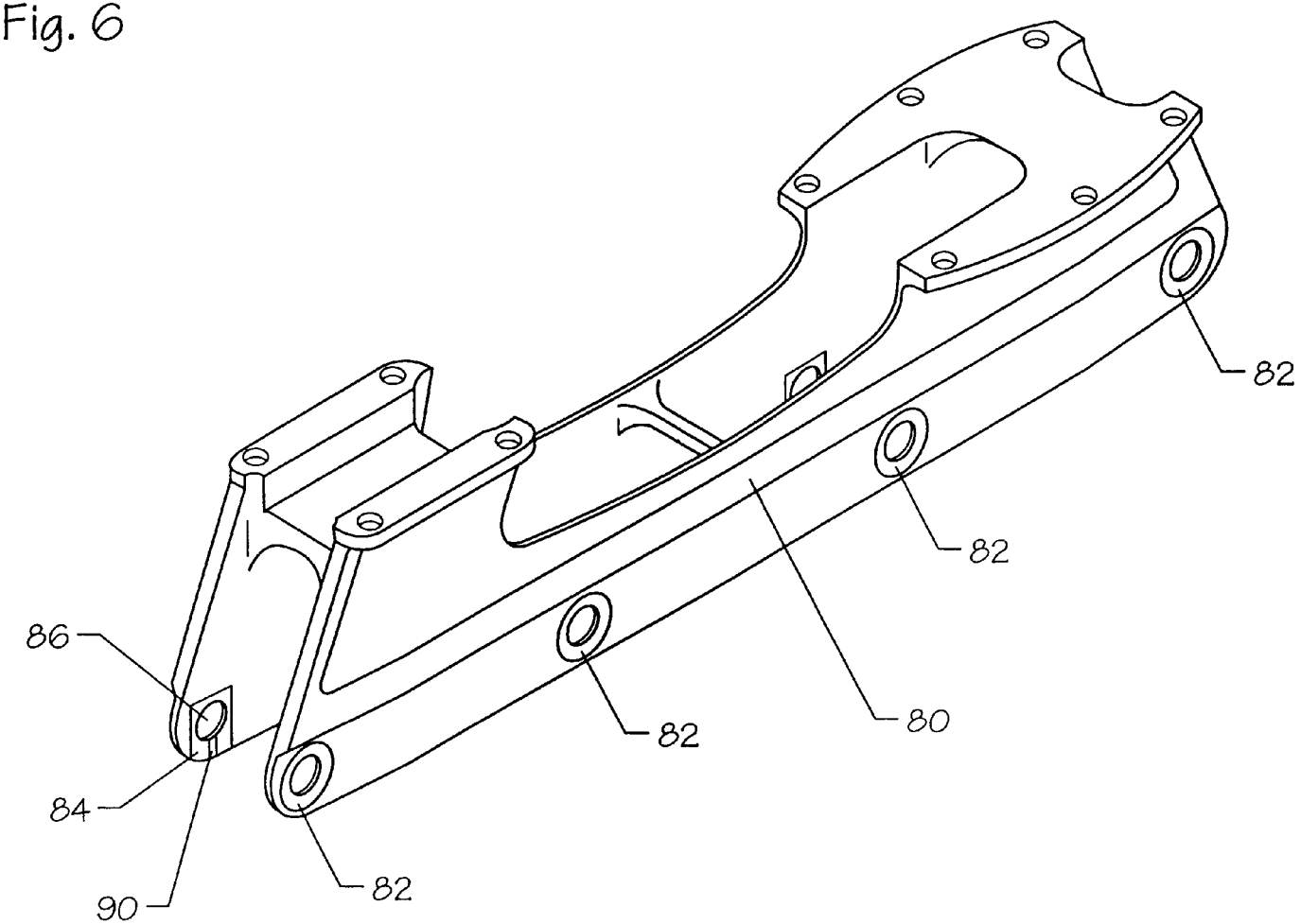
FIG. 6 is a perspective view illustrating the blade frame constructed in accordance with the present invention.
Figure 7:
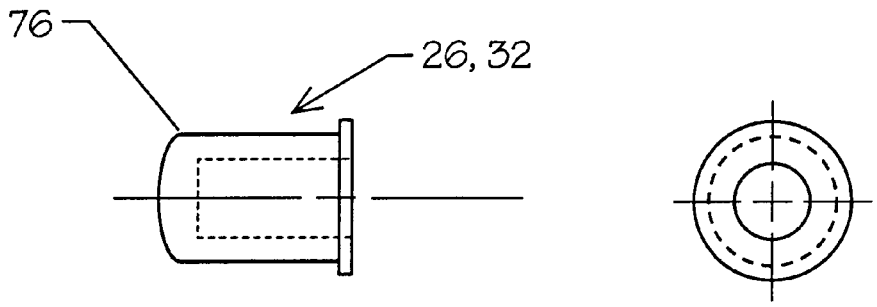
FIG. 7 is a side view illustrating a portion of the in-line skate wheel axle assembly being tapered and constructed in accordance with the present invention.

As illustrated in FIGS. 6 and 7, in another embodiment of the present invention, the blade frame 12 has raised ribs 80 extending substantially the length of the blade frame 12 along the outside surface of the side walls 16 of the blade frame 12. The ribs 80, extending substantially the length of the blade frame 12, are preferably positioned above, as illustrated in FIG. 6, or in alignment with, as illustrated in FIG. 10, the opposing axle apertures 18 and extend from the horizontal around the anterior and posterior profiles until the ribs 80 reach the heel and toe plates or, as in FIG. 10, are joined by wings 100. The ribs 80 greatly increase the lateral strength and rigidity of the blade frame 12. The traditional nut and bolt axle system of the prior art, or any system that uses threaded members to effect a connection between parts serving as an axle, lends great lateral strength to any blade frame in which such a system is utilized. The quick-release wheel axle 10 of the present invention does not rely on the strength of threads, but instead on the outward horizontal force of the spring member captured between two laterally moveable tubular members 26, 32 to effect connection with the blade frame 12. The quick-release wheel axle 10, therefore, does further strengthen the blade frame 12 in which it is used as does a traditional nut and bolt system or any system that uses threaded members. The ribs 80 on the blade frame 12 create lateral strength and rigidity such that the quick-release axle 10 rides between the frame side walls 16 without the possibility of accidental release due to lateral flexion of the frame side walls 16.

The area horizontally between the axle apertures 18 and vertically between the rib 80 and the bottom of the blade frame 12 can be constructed of a thinner material than the remainder of the blade frame 12 if a second rib also extends horizontally along the bottom of the frame approximately ⅛ inch vertically and approximately the thickness of the thickest part of the blade frame 12 that surrounds the axle apertures 18.

Since the quick-release skate wheel axles 10 of the present invention are not removed or introduced into the blade frame 12 by means of tools, but by fingers, the blade frame 12 of the present invention also incorporates axle aperture depressions 82 on both sides of the blade frame 12 facilitating insertion and removal of the wheel assembly 14. The depressions 82 are formed on the outside surface of the side walls 16 of the blade frame 12 surrounding each axle aperture 18. The depressions 82 are dimensioned allowing finger tip access to the exposed ends of the quick-release skate wheel axles 20.

Some recess around the axle apertures 18 will still be preferred even if the material is strong enough to allow the frame to be constructed without the depressions 82. The depressions 82 not only allow easy access to the closed first ends 28, 34, but protect the closed first ends 28, 34 from contact by anything larger than a finger tip or thumb tip, for example, the skating surface or curbs or anything similar that could damage the closed first ends 28, 34.

The wheel spacer 84 also incorporates an axle guide channel 90 to facilitate removal and insertion of the wheel assembly 14. The axle guide channel 90 has a vertical trough dimensioned horizontally accommodating the closed first ends 28, 34 of the first and second tubular members 26, 32, respectively, as the wheel axle 20 is removed from or inserted into the blade frame 12. The guide channel 90 extends vertically from the bottom of the insertion aperture 86 to the bottom of the frame side wall 16 which is, but not necessarily, coterminous, in the preferred embodiment, with the bottom edge of the blade frame 12. The depth of the guide channel 90 is partially determined by the thickness of the wheel spacer 84 of the axle insertion 83 and partially by the thickness of the side wall 16 of the blade frame 12 to which the guide channel 90 is attached and partly by the travel space allowed between the open axle ends captured in the housing.

Whereas the blade frame 12 is preferably constructed of a relatively soft, light material, such as aluminum 7075 or high impact plastic such as is known in the art, the insertions 83 can be constructed of a material similar to the material used for the wheel axle 20, such as stainless steel, for example. Stainless steel inhibits wear and burring of the type likely to be encountered in the conditions to which the wheel axle 20 and insertion 83 are subjected. The features of the wheel spacer remain the same whether or not the spacer is manufactured separately or machined at the same time from the same integral material as the blade frame 12.

As noted above, accidental release of an in-line skate wheel due to loose bolts, for example, could potentially cause serious injury. The quick-release skate wheel axle 10 of the present invention inhibits such release in at least three ways. First, both of the closed first ends 28, 34 of the first and second tubular members 26, 32, respectively, must be depressed simultaneously and completely and, at the same time, together with the user pulling the wheel assembly 14 out and away from the opposing apertures 18 in order to remove the wheel assembly 14.

Second, the compression spring member 38, though not so strong as to make depression of the closed first ends 28, 34 impossible for an average user, is sufficiently strong to resist incidental depression and forces the closed first end 28, 34 of the first and second tubular members 26, 32, respectively, back into place before they can slip from opposing apertures 18 unintentionally. The spring member 38 is designed to provide an adequate force for the wheel axle 20 of the present invention, and, contrasted to known prior art designs, the wheel axle 20 of the present invention never needs tightening.

Third, whereas when there is no pressure on the skate wheel 22, the axle tips 28, 34 can be moved to and fro, when there is pressure, much less than exerted even by a child skater, the friction between the exterior of the axle tip 28, 34 and the interior of the axle aperture 18 in the blade frame 12 substantially inhibits the moving of the axle tips 28, 34. The wheel axle 10 of the present invention, thereby, solves the problem of accidental release better than any known prior art.

The materials needed for all the various parts of the wheel axle 10 of the present invention are similar to those now used in the field. The friction material of the wheel 22, the plastics used for the wheel housing 23, and the steel and aluminum material involved are those presently being used in this industry. Any lubrications, bushings, ball bearings, and other rotating mechanisms and ancillary requirements are similar to those commonly used in the industry, including but not limited to titanium, aluminum alloys such as #7075, #6061, brass and steel.

With the wheel axle 20 of the present invention, the blade frame 12 can sometimes require additional lateral rigidity or support. To add lateral support, as illustrated in FIG. 10, the blade frame 12 includes at least one wing or support arm 100 extending between the toe plate 92 and/or heel plate 94 and the side walls 96. In a preferred embodiment, there are four diagonal wings 100, two wings 100 connected to the toe plate 92 and two wings connected to the heel plate 94. Preferably, a hollow portion 98 extends between each of the wings 100 and the side walls 96 of the blade frame 12. The wings 100 can extend up to the entire length of the toe plate 92 and the heel plate 94 and maximize the rigidity of the blade frame 12 during skating.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. An axle assembly for in-line skate wheels, wherein each wheel is arranged between frame extensions having a plurality of opposing apertures, the axle assembly comprising:

a housing having a first open end, a second open end, and a longitudinal axis;

a first tapered axle end movable along the longitudinal axis within the first open end of the housing;

a second tapered axle end movable along the longitudinal axis within the second open end of the housing; and means for biasing the ends in a general direction away from each other to urge the ends into the opposing apertures in the frame extensions.

2. The axle assembly of claim 1 wherein the ends are tapered to approximately five (5°) degrees.

3. The axle assembly of claim 1 wherein the ends are movable along a longitudinal axis of the axle.

4. The axle assembly of claim 1 wherein the means for biasing comprises spring means for urging the ends apart.

5. The axle assembly of claim 1 wherein each of the apertures in the frame extensions are tapered.

6. The axle assembly of claim 5 wherein the taper of the apertures in the frame extensions is substantially equal to the taper of the ends.

7. The axle assembly of claim 1 and further including means for limiting the extent of travel of the first and second ends relative to the housing.

8. A method for mounting and removing a wheel from an in-line skate frame structure, the method comprising the steps of:

providing an axle having a pair of opposite movable ends;

providing a taper on each of the movable ends of the axle;

inserting the axle into the wheel;

providing a plurality of opposing apertures in the frame structure; and depressing the movable ends of the axle of the wheel, the movable ends of each of the axles extending through each pair of opposing apertures in the frame structure.

9. The method of claim 8 and further comprising:

slipping the wheel from the blade frame when the ends of the axle clear the inner surfaces of the frame structure.

10. The method of claim 9 and further comprising:

depressing the movable ends of the axle of the wheel; and slipping the wheel into the blade frame when the ends of the axle clear the inner surfaces of the frame structure.

11. A blade frame for an in-line skate, the blade frame carrying at least one wheel assembly, the wheel assembly having a wheel axle with a non-rotatable first axle end and a non-rotatable second axle end movable toward each other and biased in a direction generally away from each other and retained in a housing, the blade frame comprising:

a first aperture in the blade frame;

a second aperture in the blade frame, the second aperture aligned with the first aperture;

a first tapered portion within the first aperture, at least a portion of the first axle end received and positioned within the first tapered portion; and a second tapered portion within the second aperture, at least a portion of the second axle end received and positioned within the second tapered portion.

12. The blade frame of claim 11 wherein the tapered portion has taper of approximately five (5°) degrees.

13. The blade frame of claim 11 wherein the first axle end has a first taper and the second axle end has a second taper, the first taper being received within the first tapered portion and the second taper being received within the second tapered portion.

14. The blade frame of claim 13 wherein the first taper of the first axle end is substantially equal to the first tapered portion and the second taper of the second axle end is substantially equal to the second tapered portion.

* * * * *